US009637144B2

(12) United States Patent
Atmur et al.

(10) Patent No.: US 9,637,144 B2
(45) Date of Patent: May 2, 2017

(54) ROTATIONAL JOINT HAVING PRELOADING ELEMENT FOR A RAILWAY CAR

(71) Applicant: The Boeing Company, Chicago, IL (US)

(72) Inventors: Robert J. Atmur, Whittier, CA (US); Thorin Arthur Rogers, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 157 days.

(21) Appl. No.: 14/600,368

(22) Filed: Jan. 20, 2015

(65) Prior Publication Data

US 2016/0144873 A1 May 26, 2016

Related U.S. Application Data

(63) Continuation-in-part of application No. 14/551,504, filed on Nov. 24, 2014.

(51) Int. Cl.

| | |
|---|---|
| ***B61F 5/16*** | (2006.01) |
| ***B61F 5/38*** | (2006.01) |
| ***E01B 7/20*** | (2006.01) |

(52) U.S. Cl.

CPC ..... *B61F 5/16* (2013.01); *B61F 5/38* (2013.01); *E01B 7/20* (2013.01)

(58) Field of Classification Search

CPC ..... B61F 5/00; B61F 5/02; B61F 5/16; B61F 5/18; B61F 5/20; B61F 5/22; B61F 5/24; E01B 7/00; E01B 7/02; E01B 7/10

See application file for complete search history.

(56) References Cited

U.S. PATENT DOCUMENTS

| | | | | |
|---|---|---|---|---|
| 3,783,793 | A | 1/1974 | Perrott et al. | |
| 4,005,839 | A | 2/1977 | Frank | |
| 4,862,807 | A | 9/1989 | Guadagno | |
| 8,577,585 | B2 | 11/2013 | Atmur et al. | |
| 2012/0031298 | A1* | 2/2012 | Kurahashi | B61B 10/04 105/215.2 |
| 2016/0144874 | A1 | 5/2016 | Atmur et al. | |

* cited by examiner

*Primary Examiner* — R.J. McCarry, Jr.
(74) *Attorney, Agent, or Firm* — Thompson Hine LLP

(57) ABSTRACT

A railway car for traveling within a switch of a railway track is disclosed. The railway car includes a body portion for containing goods and a truck portion that is a framework for carrying a plurality of wheels of the railway car. The truck portion is connected to the body portion and is rotatable about an axis of rotation relative to the body portion. The railway car also includes a rotational joint defining the axis of rotation which the truck portion is rotatable about. The rotational joint rotatably connects the truck portion to the body portion of the railway car.

20 Claims, 10 Drawing Sheets

ROTATIONAL JOINT HAVING PRELOADING ELEMENT FOR A RAILWAY CAR

RELATED APPLICATIONS

This application is a continuation-in-part of U.S. application Ser. No. 14/551,504, filed on Nov. 24, 2014.

FIELD

The disclosed system relates to a railway car and, more particularly, to a rotational joint including a preloading element for a railway car that is used to guide railway car wheels from a set of main tracks to a set of diverging tracks.

BACKGROUND

Railroad switches enable a railway train to be guided from one track to another at a railway junction. The switch generally has a straight or through track and a diverging track. The switch may include a pair of linked tapering rails, which are commonly referred to as point rails. The point rails may be positioned between outer rails of the through track. The point rails may be actuated in a lateral direction and into one of two positions in order to determine whether a train should be led towards the straight path, or towards the diverging path.

Switches also have moving parts that actuate the point rails back and forth between the two positions in order to lead the train towards the through track or the diverging track. However, those skilled in the art will readily appreciate that moving parts typically require frequent inspections, maintainance, and replacement. For example, some moving switch elements include a lifetime of ten years/10,000 cycles maximum. Thus, in applications where switching may occur at rates of millions of cycles during the life of the track, replacement and maintainance of the moving parts within the track may become costly and time consuming. There are some partially passive switches currently available that only require one moving switch point or a sacrificial element to divert the train. However these partially passive switches and sacrificial elements also wear relatively quickly, and therefore need replacement as well.

Thus, there exists a continuing need in the art for an effective railroad switch that overcomes the above mentioned problems. Moreover, in general, there is also a continuing need in the art for alternative approaches that allow for railroad cars to switch tracks which also overcome the above mentioned problems.

SUMMARY

In one aspect, a railway car for traveling within a switch of a railway track is disclosed. The railway car includes a body portion for containing goods and a truck portion that is a framework for carrying a plurality of wheels of the railway car. The truck portion is connected to the body portion and is rotatable about an axis of rotation relative to the body portion. The railway car also includes a rotational joint defining the axis of rotation which the truck portion is rotatable about. The rotational joint rotatably connects the truck portion to the body portion of the railway car.

In another aspect, a method of switching a railway car from main tracks to diverging tracks of a railway track when the railway car is traveling in a facing direction is disclosed. The method includes guiding a plurality of wheels of the railway car along the main track. The railway car includes a body portion and a truck portion that is rotatable about an axis of rotation relative to the body portion. The method also includes exerting a biasing force by a preloading element that rotates the truck portion about the axis of rotation. The preloading element is part of a rotational joint that defines the axis of rotation which the truck portion is rotatable about. Finally, the method includes guiding the plurality of wheels of the railway car through a switch of the railway track and onto the diverging track as the plurality of wheels travel in the facing direction.

Other objects and advantages of the disclosed method and system will be apparent from the following description, the accompanying drawings and the appended claims.

DETAILED DESCRIPTION

Figure 1:
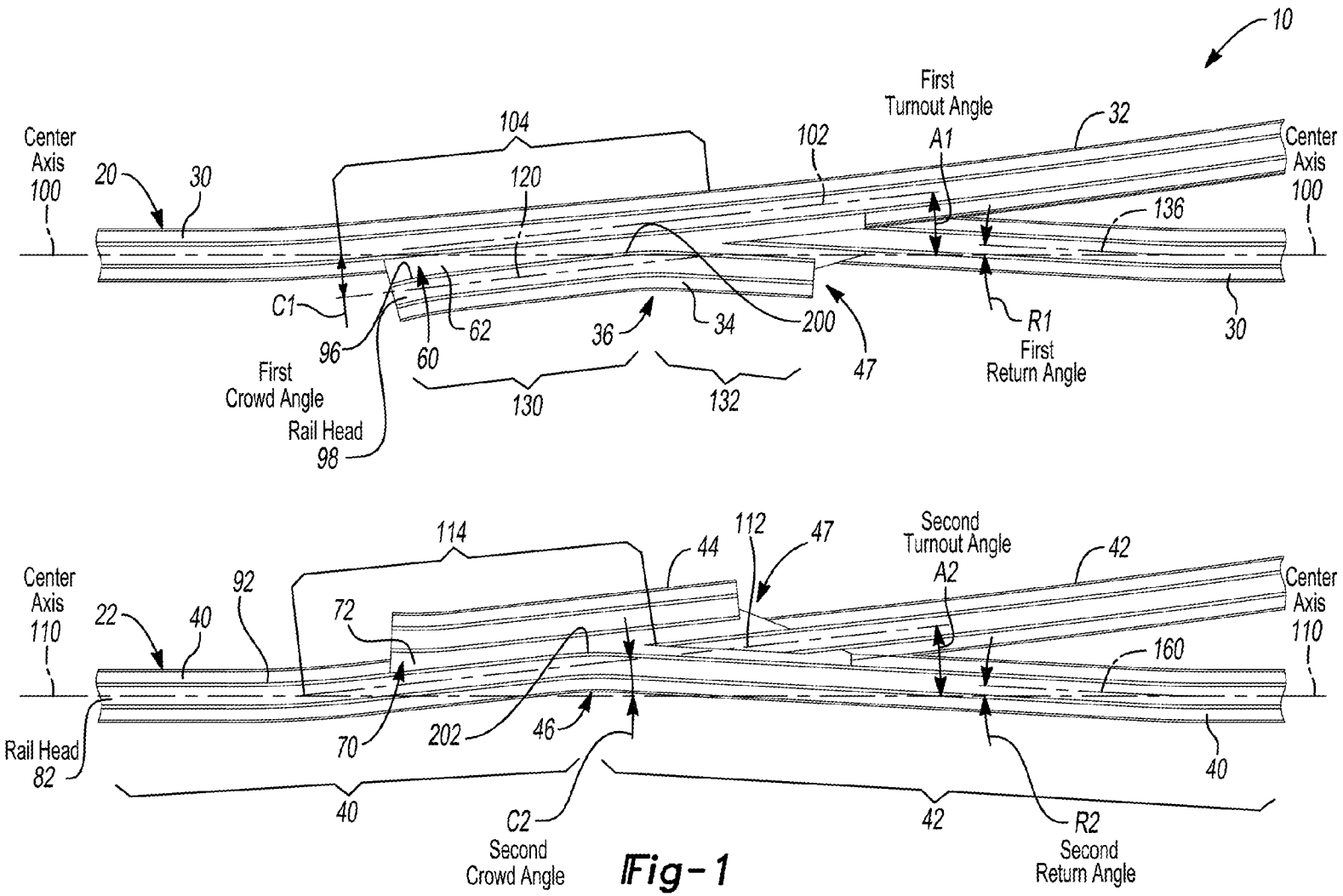
FIG. 1 is a top view of an exemplary passive switch located along a railway track, where the railway track includes a first track section and a second track section.

As shown in FIG. 1, the disclosed railway track 10 according to an aspect of the disclosure may include a first track section 20 and a second track section 22. The first track section 20 may include a through or main track 30, a diverging track 32, and a guard rail 34. The second track section 22 may include a main track 40, a diverging track 42, and a guard rail 44. The guard rail 34 of the first track section 20 may be curved at a bend or elbow 36. The shape of the guard rail 34 may be used to guide a railway car 50 (shown in FIG. 3) along the railway track 10, which is explained in greater detail below. Similarly, the main track 40 of the second track section 22 may be curved at a bend or elbow 46. Similar to the elbow 36 of the guard rail 34, the main track 40 may also be shaped to guide the railway car 50 (FIG. 3) along the railway track 10, which is also explained in greater detail below.

The first track section 20 and the second track section 22 may both be part of a passive switch 47 of the railway track 10. As explained in greater detail below, the passive switch 47 does not require moving parts to guide the railway car 50 along the railway track 10. Instead, the geometry or shape of the first track section 20 as well as the second track section 22 guides the railway car 50 along the railway track 10. It is to be understood that while the first track section 20 includes the guard rail 34 for guiding the railway car 50, in an alternative embodiment the guard rail 44 of the second track section 22 may be curved instead to guide the railway car 50. Additionally, the main track 30 of the first track section 20 may be curved instead to guide the railway car 50. In other words, the orientation of the first track 20 relative to the second track 22 as shown in the figures should not be limiting.

Figure 3:
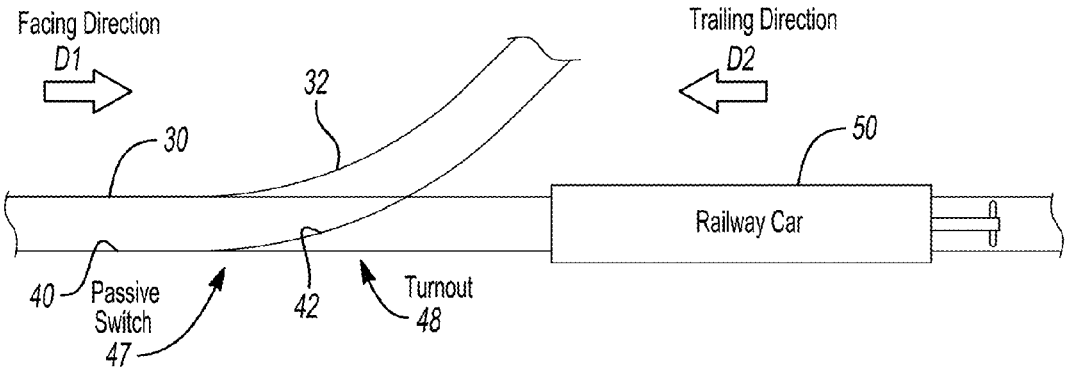
FIG. 3 is a schematic view of the railway track shown in FIG. 1, where a railway car is travelling along the railway track.

Referring to both FIGS. 1 and 3, the passive switch 47 guides the railway car 50 from the main tracks 30, 40 and onto the diverging tracks 32, 42 as the railway car 50 travels in a facing direction D1 along the railway track 10. The passive switch 47 also allows the railway car 50 to stay on the main tracks 30, 40 when the railway car 50 travels in a trailing direction D2, which is opposite to the facing direction, along the railway track 10. Furthermore, the passive switch 47 may also guide the railway car 50 from the diverging tracks 32, 42 and onto the main tracks 30, 40 as the railway car 50 is travelling in the trailing direction D2 along the railway track 10. As seen in FIG. 3, the passive switch 47 is positioned upstream of a turnout 48 of the railway track 10 when viewed along the facing direction D1.

Turning back to FIG. 1, the first track section 20 and the second track section 22 each include respective raised sections, which are referred to as flooded sections. Specifically, the first track section 20 includes a flooded section 60 and the second track section 22 includes a flooded section 70. The flooded section 60 of the first track section 20 may include a raised or elevated surface 62 disposed between the main track 30 and the guard rail 34. A portion of the flooded section 60 of the first track section 20 may also be located between the main track 30 and the diverging track 32. Similarly, the flooded section 70 of the second track section 22 may also include a raised or elevated surface 72 disposed between the main track 40 and the guard rail 44. A portion of the flooded section 70 may also be located between the main track 40 and the diverging track 42.

Figure 2:
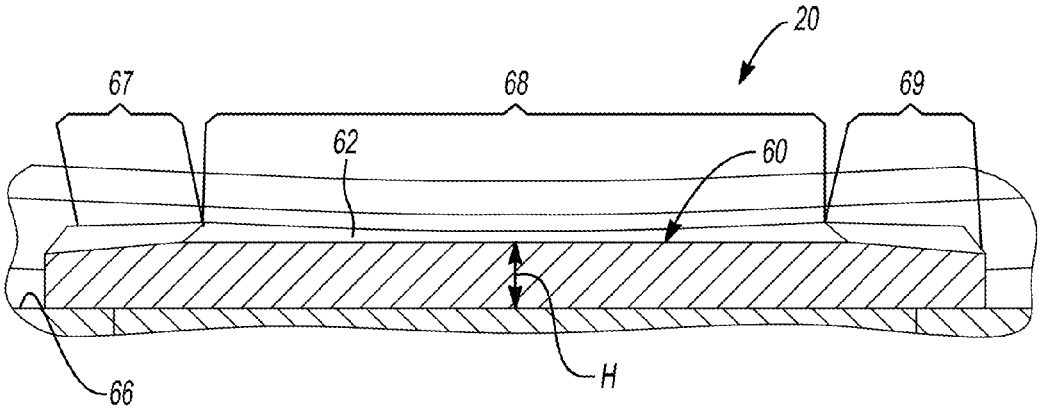
FIG. 2 is a cross-sectioned view of the first track section shown in FIG. 1.

Turning to FIG. 2, a cross-sectioned view of the first track section 20 taken along the flooded section 60 is shown. The flooded section 60 represents a raised or elevated section of track having a height H. The height H of the flooded section 60 may be measured between a bottom surface 66 of the first track section 20 and the elevated surface 62 of the flooded section 60. The flooded section 60 may also include a ramped configuration. As seen in FIG. 2, the flooded section 60 may include a first ramped section 67 of increasing height, a straight or level section 68, and a second ramped surface 69 of decreasing height. Although only the flooded section 60 of the first track section 20 is illustrated, it is to be understood that the flooded section 70 of the second track section 22 (FIG. 1) also includes similar geometry as well.

Figure 4:
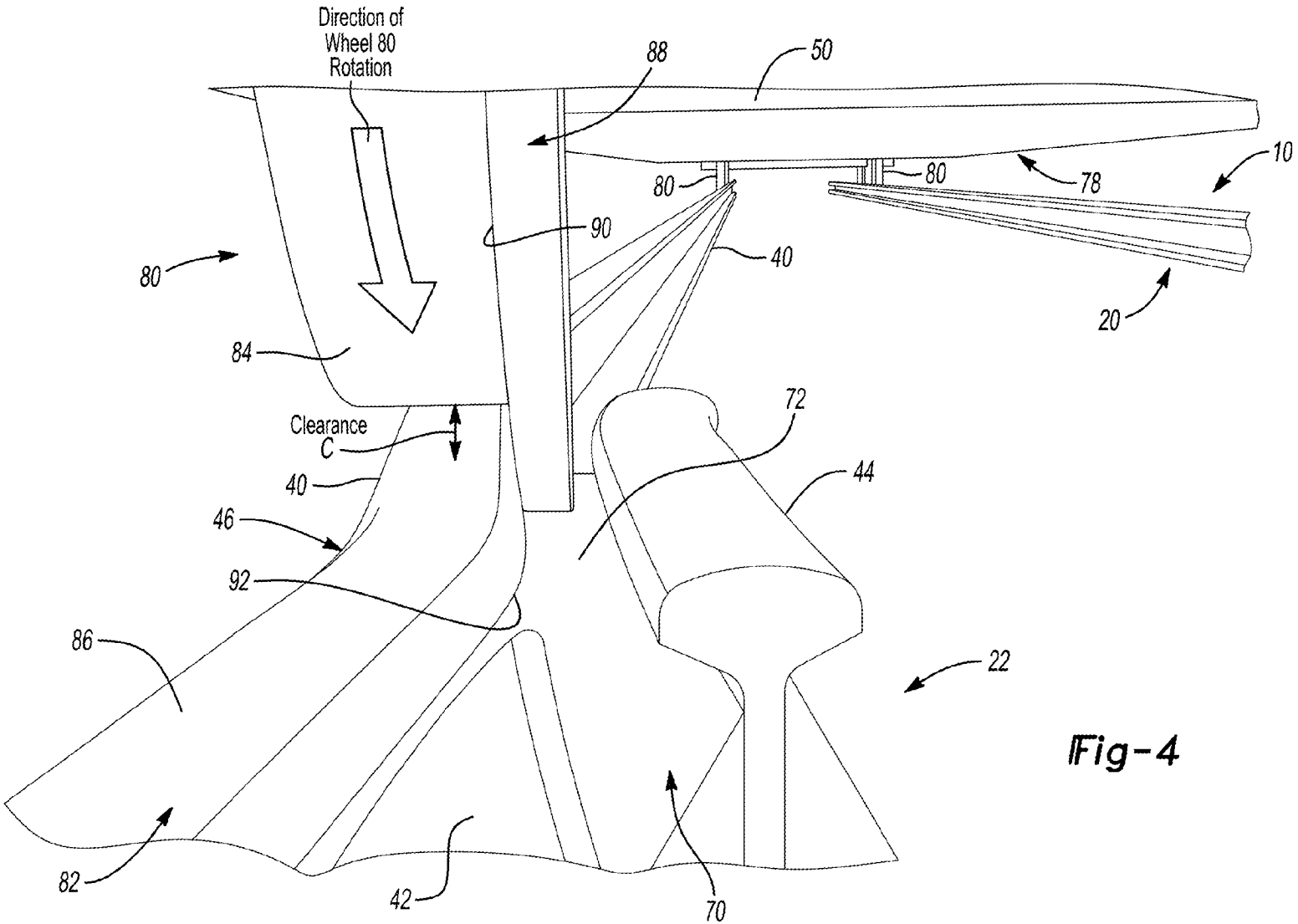
FIG. 4 is an enlarged view illustrating a wheel of the railway car traveling within the passive switch.

Both the flooded sections 60, 70 may be used to raise respective wheels of the railway car 50 as the railway car 50 travels along the passive switch 47. Turning to FIG. 4, one of the railway car wheels 80 of the railway car 50 is illustrated travelling along the second track section 22, at the flooded section 70. Those skilled in the art will readily appreciate that when the wheel 80 is not rolling along the flooded section 70, a rolling surface 84 of the railway car wheel 80 may contact and roll against a first surface 86 of a rail head 82 of the main track 40. However, as seen in FIG. 4, once the wheel 80 travels within the flooded section 70 of the second track section 22, the rolling surface 84 of the wheel 80 may deflect away from the rail head 82 of the main track 40 such that there is a clearance C between the rolling surface 84 of the wheel 80 and the rail head 82 of the main track 40.

Continuing to refer to FIG. 4, when the wheel 80 travels within the flooded section 70 of the second track section 22, a flange 88 of the wheel 80 makes contact with and rolls against the elevated surface 72 of the flooded section 70. Thus, when the wheel 80 rolls within the flooded section 70, this travel of the wheel 80 may be referred to as flange riding travel. In other words, the wheel 80 as seen in FIG. 4 is flange riding because the flange 88 of the wheel 80 rolls against the elevated surface 72 of the flooded section 70.

When the wheel 80 is flange riding, an outermost side surface 90 of the flange 88 of the wheel 80 may abut against an innermost side surface 92 of the rail head 82 of the main track 40. The abutment between the wheel 80 and the rail head 82 may position and guide the railway car 50 along the railway track 10. Specifically, the main track 40 is bent at the elbow 46 in order to guide the wheel 80 along the railway track 10, which is described in greater detail below. The guard rail 44 of the first track section 20 may be used to ensure that the wheel 80 does not derail from the second track section 22 when the wheel 80 is flange riding. Those skilled in the art will readily appreciate that although only the second track section 22 is illustrated in FIG. 4, another wheel 80 on an opposite side 78 of the railway car 50 may also be flange riding when rolling within the flooded section 60 (FIG. 1) of the first track section 20, which is explained below.

Figure 5:
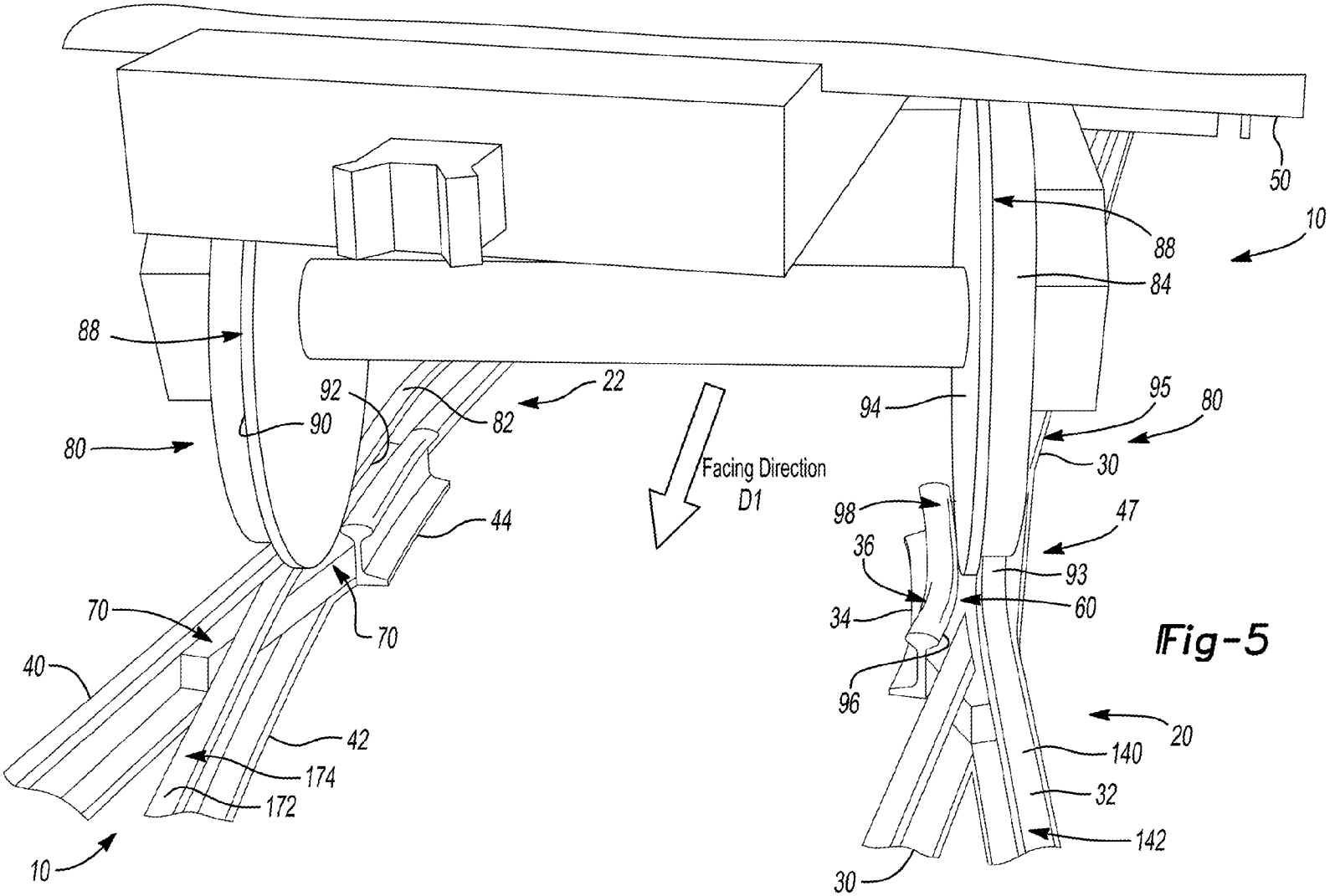
FIG. 5 is a perspective view of two wheels of the railway car being guided through the passive switch as the railway car moves in a facing direction.

Turning now to FIG. 5, an illustration of the railway car 50 entering the passive switch 47 while travelling in the facing direction D1 is shown. As seen in FIG. 5, the flange 88 of one of the wheels 80 of the railway car 50 also rolls within the flooded section 60 of the first track section 20. As explained above, when the wheel 80 is flange riding within the flooded section 60, the rolling surface 84 of the wheel 80 may no longer make contact with a first surface 93 of a rail head 95 of the main track 30. Moreover, when the wheel 80 is flange riding within the flooded section 60, an innermost side surface 94 of the flange 88 of the wheel 80 may abut against an outermost side surface 96 of a rail head 98 of the guard rail 44. The abutment between the wheel 80 and the rail head 98 of the guard rail 44 may also position and guide the railway car 50 along the railway track 10. Specifically, the guard rail 44 may be bent at the elbow 36 in order to guide the wheel 80 along the railway track 10, which is described in greater detail below.

Turning back to FIG. 1, both the first track section 20 and the second track section 22 each define corresponding initial turnout angles. Specifically, the first track section 20 defines a first turnout angle A1. The first turnout angle A1 may be defined between the main track 30 and the diverging track 32. The first track section 20 defines a substantially straight center axis 100. As seen in FIG. 1, the center axis 100 extends in a substantially longitudinal direction along a portion of the main track 30.

The first track section 20 also defines a second axis 102. The second axis 102 is aligned with a portion of the main track 30 and the diverging track 32. Specifically, the second axis 102 is aligned with the main track 30 at a curved section 104. The curved section 104 represents where the main track 30 bends or curves in a direction away from the center axis 100 of the first track section 20, and transitions into the diverging track 32. The first turnout angle A1 is measured between the center axis 100 and the second axis 102 of the first track section 20.

Similarly, the second track section 22 defines a second turnout angle A2. The second turnout angle A2 may be defined between the main track 40 and the diverging track 42. The second track section 22 defines a substantially straight center axis 110. Specifically, the center axis 110 extends in a substantially longitudinal direction along a portion of the main track section 40. As seen in FIG. 1, even as the main track 40 bends at the elbow 46, the center axis 110 still remains substantially straight. The second track section 22 defines a second axis 112. The second axis 112 of the second track section 22 is aligned with a portion of the main track 40 as well as the diverging track 42. Specifically, the second axis 112 is aligned with a curved section 114 of the main track 40. The curved section 114 represents where the main track 40 bends or curves at the elbow 46 in a direction away from the center axis 110, and transitions into the diverging track 42. The second turnout angle A2 is measured between the center axis 110 and the second axis 112 of the second track section 22.

It is to be understood that the first turnout angle A1 and the second turnout angle A2 may be substantially identical in dimension with one another. For example, in one embodiment the first turnout angle A1 and the second turnout angle A2 may be standard size turnout angles (e.g., a number 4 turnout, or a number 6 turnout, etc.).

Referring to FIGS. 1 and 3, the first track section 20 and the second track section 22 may both be curved or bent in order to guide rolling stock (i.e., the railway car 50) travelling along the main tracks 30, 40 in the facing direction D1 towards the diverging tracks 32, 42. Specifically, as seen in FIG. 1, a first portion 130 of the guard rail 34 of the first track section 20 may be curved at a first crowd angle C1. A remaining or second portion 132 of the guard rail 34 may be curved or bent at a first return angle R1. The guard rail 34 is bent at the elbow 36 between the first crowd angle C1 and the first return angle R1 to create a substantially V-shaped profile.

As seen in FIG. 1, the first crowd angle C1 is measured between the center axis 100 of the first track section 20 and a curvature line 120 of the guard rail 34. Specifically, the curvature line 120 is aligned with the guard rail 34 at the first portion 130. The first return angle R1 is measured between the center axis 100 of the main track 30 and a center axis 136 of the main track 30. Specifically, the center axis 136 is aligned with a curved portion of the main track 30 that diverges towards and re-aligns with the center axis 100 of the first track section 20.

The first crowd angle C1 is at least substantially equal to the first turnout angle A1 of the first track section 20. However, it is to be understood that the first crowd angle C1 is less than twice the first turnout angle A1 of the first track section 20. The first return angle R1 may be any dimension that allows for the wheel 80 of the railway car 50 to be guided towards the elbow 36 of the guard rail 34 as the railway car 50 travels in the trailing direction D2, which is explained in greater detail below.

Referring to FIGS. 1 and 5, when one of the wheels 80 of the railway car 50 is travelling in the facing direction D1 and enters the flooded section 60 of the first track section 20, the wheel 80 becomes flange riding. It is to be understood that the guard rail 34 is shaped to guide the wheel 80 from the main track 30 onto the diverging track 32 as the railway car 50 travels in the facing direction D1. The travel of the wheel 80 from the main track 30 onto the diverging track 32 is described in detail below.

Continuing to referring to FIGS. 1 and 5, the innermost side surface 94 of the flange 88 of the wheel 80 abuts against the outermost side surface 96 of the rail head 98 of the guard rail 34 at the first crowd angle C1 when the wheel 80 is flange riding. Once the outermost side surface 96 of the guard rail 34 makes contact with the flange 88 of the wheel 80, the guard rail 34 may guide the wheel 80 through the flooded section 60 of the first track section 20. Specifically, the innermost side surface 94 of the flange 88 of the wheel 80 abuts against the outermost side surface 96 of the guard rail 34 at the first crowd angle C1. When the wheel 80 travels in the facing direction D1, the crowd angle C1 guides the wheel 80 along the curved section 104 of the main track 30. As best seen in FIG. 1, the curved section 104 of the main track 30 eventually transitions into the diverging track 32. As a result, once the wheel 80 exits the flooded section 60 of the first track section 20 and is no longer flange riding, the wheel 80 may now roll along the diverging track 32. In particular, the rolling surface 84 of the wheel 80 may contact and roll against a first surface 140 of a rail head 142 of the diverging track 32 (seen in FIG. 5).

Figure 6:
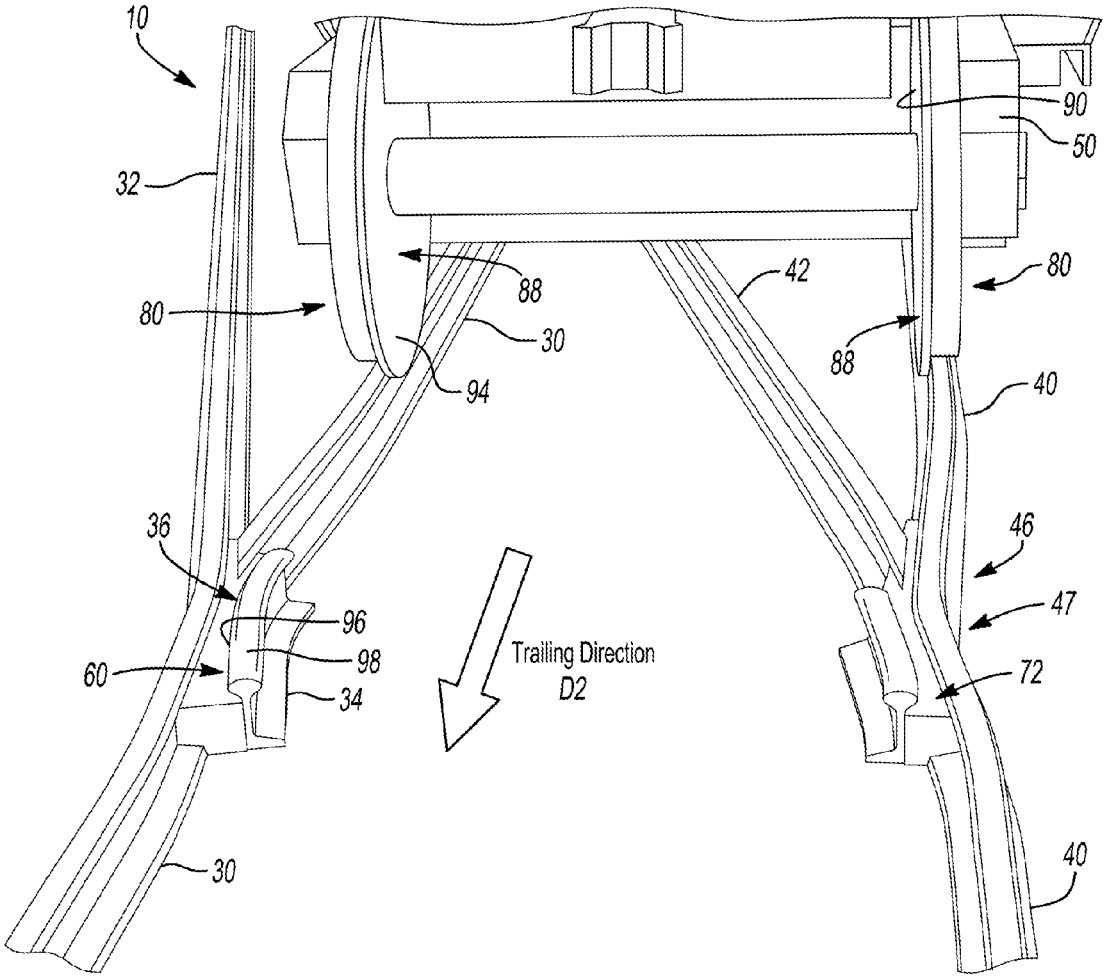
FIG. 6 is a view of two wheels of the railway car being guided through the passive switch as the railway car moves in a trailing direction.

The passive switch 47 also allows for railway cars 50 travelling in the trailing direction D2 to remain on the main tracks 30, 40. FIG. 6 is an illustration of the railway car 50 travelling in the trailing direction D2 along the main tracks 30, 40, and towards the passive switch 47. Referring to FIGS. 1, 3 and 6, the passive switch 47 may also guide the railway car 50 along the main track 30. Specifically, as one of the wheels 80 of the railway car 50 rolls along the main track 30 and into the flooded section 60 of the first track section 20 to become flange riding, the outermost side surface 96 of the rail head 98 of the guard rail 34 abuts against the innermost side surface 94 of the flange 88 of the wheel 80 at the first return angle R1.

The first return angle R1 is angled to provide guidance to the wheel 80, and directs the wheel 80 towards an apex 200 of the elbow 36 of the guard rail 34 (the apex 200 is shown in FIG. 1). The guard rail 34 transitions from the first return angle R1 and into the first crowd angle C1 at the apex 200 of the elbow 36 of the guard rail 34. Once the wheel 80 rolls over the apex 200 of the elbow 36, the wheel 80 may continue to contact and roll against the outermost side surface 96 of the guard rail 34 along the first crowd angle C1. Thus, once the wheel 80 exits the flooded section 60 of the first track section 20 and is no longer flange riding, the wheel 80 continues to roll along the main track 30.

Referring to FIGS. 1, 3 and 5, the passive switch 47 may also guide the railway car 50 travelling along the diverging track 32 and onto the main track 30 as the railway car 50 travels in the trailing direction D2. Specifically, one of the wheels 80 of the railway car 50 may roll along the diverging track 32 in the trailing direction D2 and enter the flooded section 60 of the first track section 20 to become flange riding. Eventually, the innermost side surface 94 of the flange 88 of the wheel 80 makes contact with and abuts against the outermost side surface 96 of the rail head 98 of the guard rail 34 at the first crowd angle C1. As the wheel 80 travels in the trailing direction D2, the crowd angle C1 of the guard rail 34 guides the wheel 80 along the curved section 104 of the main track 30. As a result, once the wheel 80 exits the flooded section 60 of the first track section 20 and is no longer flange riding, the wheel 80 may roll along the main track 30.

Turning back to FIG. 1, the second track section 22 also includes a similar configuration for guiding the railway car 50 (FIG. 3) through the passive switch 47. However, unlike the first track section 20, the main track 40 may be bent instead of the guard rail 34. Specifically, as seen in FIG. 1, the main track 40 of the second track section 22 may be bent or curved at a second crowd angle C2 as well as at a second return angle R2. The main track 40 may include a substantially V-shaped profile, which is similar to the V-shaped profile of the guard rail 34. As explained in greater detail below, the main track 40 may also be curved or bent in a direction that corresponds with the curvature of the guard rail 34 in order to provide guidance to the wheels 80 of the railway car 50 (FIG. 4) when the wheels 80 are flange riding.

As seen in FIG. 1, the second crowd angle C2 is measured between the center axis 110 of the second track section 22 and the second axis 112 of the second track section 22. The second crowd angle C2 is at least substantially equal to the second turnout angle A2. The second return angle R2 is measured between the center axis 110 of the second track section 22 and a center axis 160 of the main track 40. The center axis 160 is aligned with a curved portion of the main track 40 that diverges towards and re-aligns with the center axis 110 of the second track section 22. The second return angle R2 may be substantially equal in dimension with the first return angle R1 of the first track section 20. The second return angle R2 may include any dimension that allows for the wheel 80 of the railway car 50 to be guided towards the elbow 46 of the main track 40 as the railway car 50 travels in the trailing direction D2, which is explained in greater detail below.

Referring to FIGS. 1 and 5, as the wheel 80 becomes flange riding within the flooded section 70 of the second track section 22, the main track 40 may make contact with the wheel 80. Specifically, the outermost side surface 90 of the flange 88 of the wheel 80 abuts against the innermost side surface 92 of the rail head 82 of the main track 40. The main track 30 is bent at the elbow 46 (seen in FIG. 1), and is shaped to guide the wheel 80 of the railway car 50 from the main track 40 and onto the diverging track 42 as the wheel 80 travels in the facing direction D1, and is described in detail below.

Continuing to refer to FIGS. 1 and 5, the outermost side surface 90 of the flange 88 of the wheel 80 abuts against the innermost side surface 92 of the rail head 82 of the main track 40 at the second crowd angle C2 when the wheel 80 is flange riding. As the wheel 80 travels in the facing direction D1, the second crowd angle C2 guides the wheel 80 along the curved section 114 of the main track 40. The curved section 114 of the main track 40 eventually transitions into the diverging track 42. As a result, once the wheel 80 exits the flooded section 70 of the first track section 20 and is no longer flange riding, the wheel 80 rolls along the diverging track 42. In particular, the rolling surface 84 of the wheel 80 may contact and roll against a first surface 172 of a rail head 174 (seen in FIG. 5) of the diverging track 42 once the wheel 50 exits the flooded section 70.

Referring to FIGS. 1, 3 and 6, the passive switch 47 also allows for railway car 50 travelling in the trailing direction D2 to remain on the main track 40. Specifically, as the wheel 80 of the railway car 50 rolls along the main track 40 in the trailing direction D2 and enters the flooded section 70 of the second track section 22 to become flange riding, the outermost side surface 90 of the flange 88 of the wheel 80 abuts against the innermost side surface 92 of the rail head 82 of the main track 40 at the second return angle R2. The second return angle R2 is angled to provide guidance to the wheel 80, and directs the wheel 80 towards an apex 202 of the elbow 46 of the main track 40 (the apex 202 is shown in FIG. 1). The main track 40 transitions from the second return angle R2 and into the second crowd angle C2 at the apex 202 of the elbow 46 of the main track 40. Once the wheel 80 rolls over the apex 202 of the elbow 46, the wheel 80 may continue to contact and roll against the innermost side surface 92 of the main track 40 along the second crowd angle C2. The second crowd angle C2 of the main track 40 continues to guide the wheel 80 along the main track 40. As a result, once the wheel 80 exits the flooded section 70 of the second track section 22 and is no longer flange riding, the wheel 80 continues to roll along the main track 40.

Referring to FIGS. 1, 3 and 6, the passive switch 47 may also guide the railway car 50 from the diverging track 42 and onto the main track 40 when the railway car 50 is travelling in the trailing direction D2. Specifically, the wheel 80 rolls along the diverging track 42 and into the flooded section 70 of the second track section 22 to become flange riding. The wheel 80 may continue to roll within the flooded section 70. Eventually, the outermost side surface 90 of the flange 88 of the wheel 80 makes contact with and abuts against the innermost side surface 92 of the rail head 82 of the main track 40 at the second crowd angle C2 (seen in FIG. 1). The second crowd angle C2 of the main track 40 guides the wheel 80 along the curved section 114 of the main track 40. As a result, once the wheel 80 exits the flooded section 70 of the second track section 22 and is no longer flange riding, the wheel 80 may now roll along the main track 40.

Referring generally to FIGS. 1-6, it is to be understood that the disclosed passive switch does not require moving parts that require actuation. Thus, it is to be understood that the disclosed passive switch provides various advantages and benefits when compared to a traditional railway switch, which includes numerous moving parts. In particular, since the disclosed passive switch does not include moving parts, the disclosed passive switch may last the lifetime of the railway tracks. Moreover, the disclosed passive switch also does not generally require periodic replacement and maintainance, unlike most railway switches that are currently available.

Figure 7:
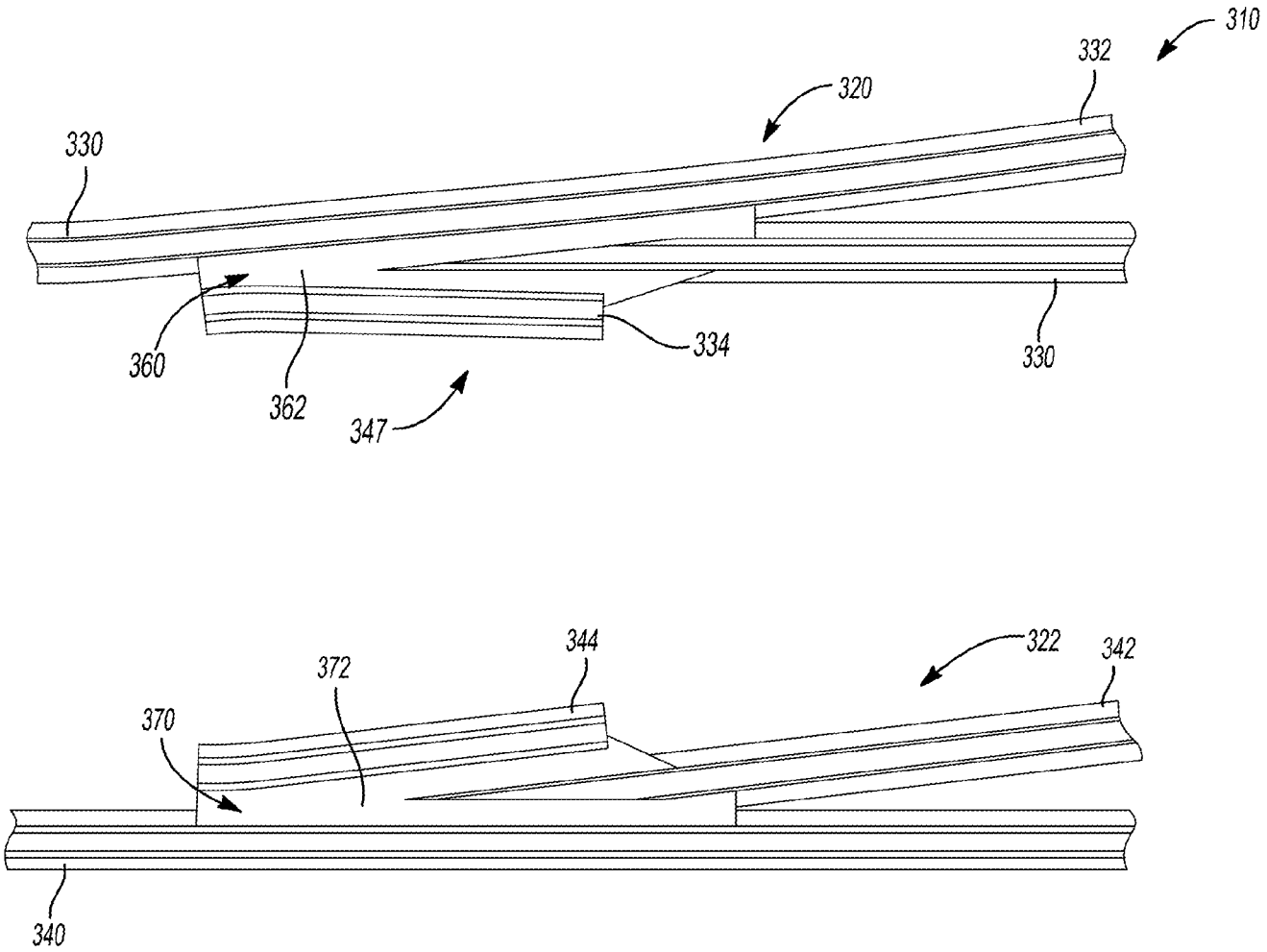
FIG. 7 is a top view of an alternative embodiment of a switch located along a railway track.

FIG. 7 is an alternative embodiment of a railway track 310 according to another aspect of the disclosure including a first track section 320 and a second track section 322. The first track section 320 may include a through or main track 330, a diverging track 332, and a guard rail 334. The second track section 322 may include a main track 340, a diverging track 342, and a guard rail 344. Unlike the embodiment as shown in FIG. 1, the guard rail 334 of the first track section 320 may be substantially straight. Similarly, the main track 340 of the second track section 322 may also be substantially straight. The first track section 320 and the second track section 322 may both be part of a switch 347 of the railway track 310.

Figure 8:
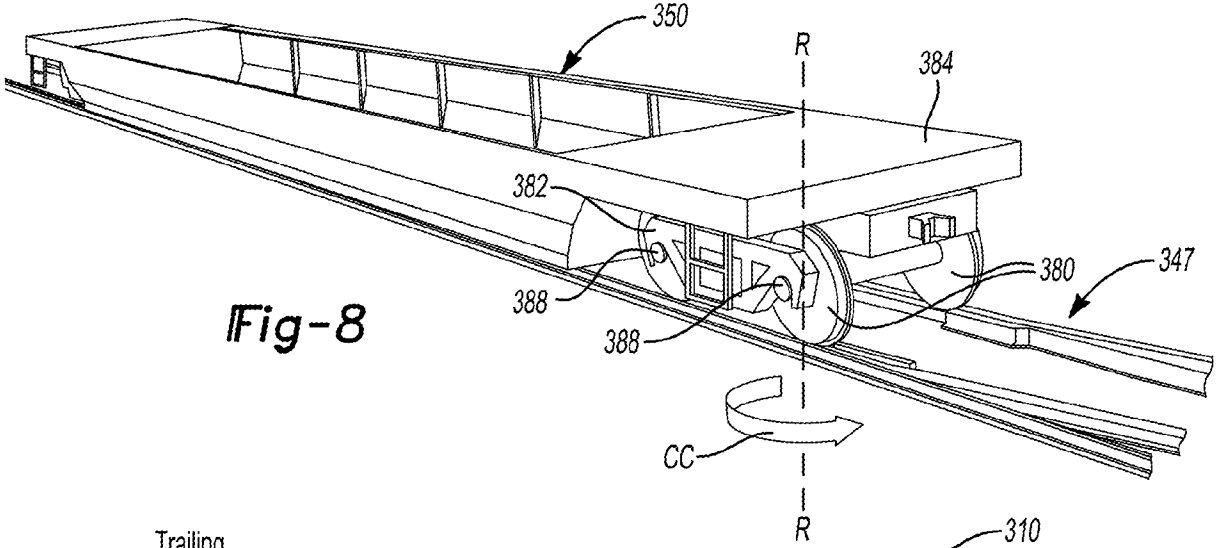
FIG. 8 illustrates the railway track shown in FIG. 7, where another railway car is travelling along the railway track.
Figure 9:
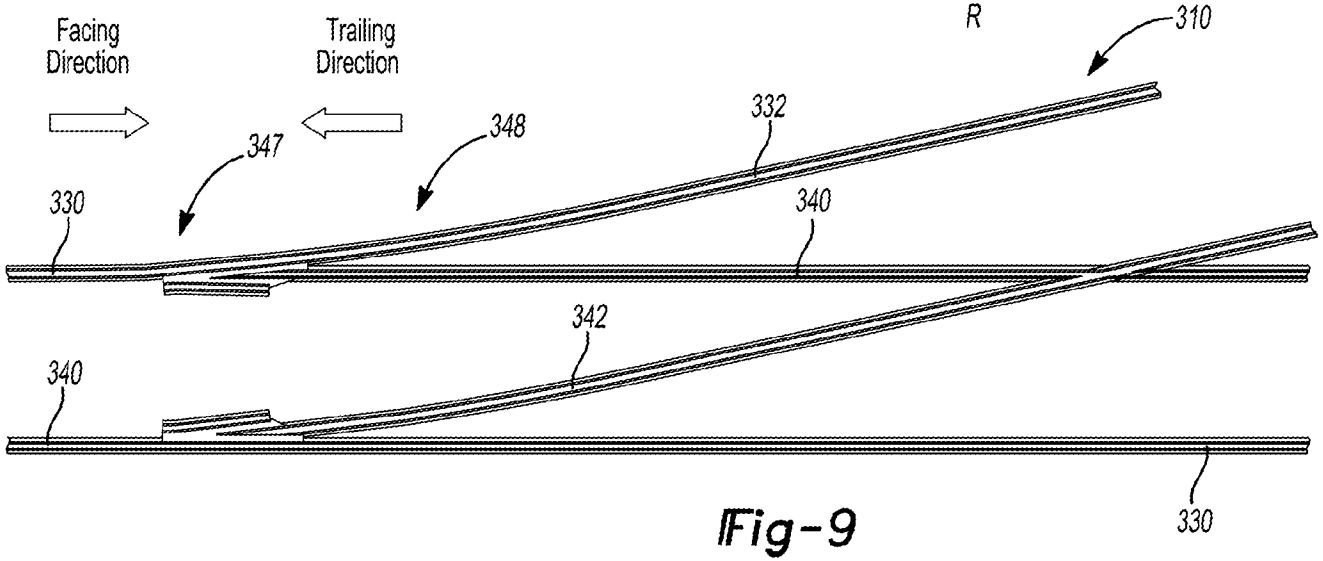
FIG. 9 is a schematic view of the railway track shown in FIG. 7.
Figure 12:
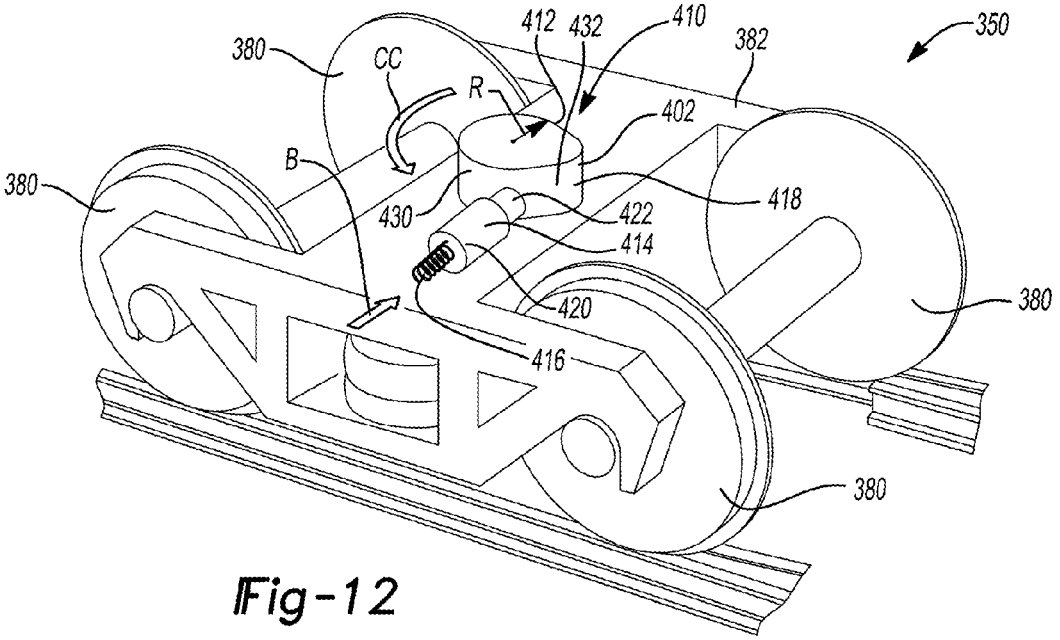
FIG. 12 is a perspective view of an embodiment of the preloading element shown in FIG. 10.
Figure 13:
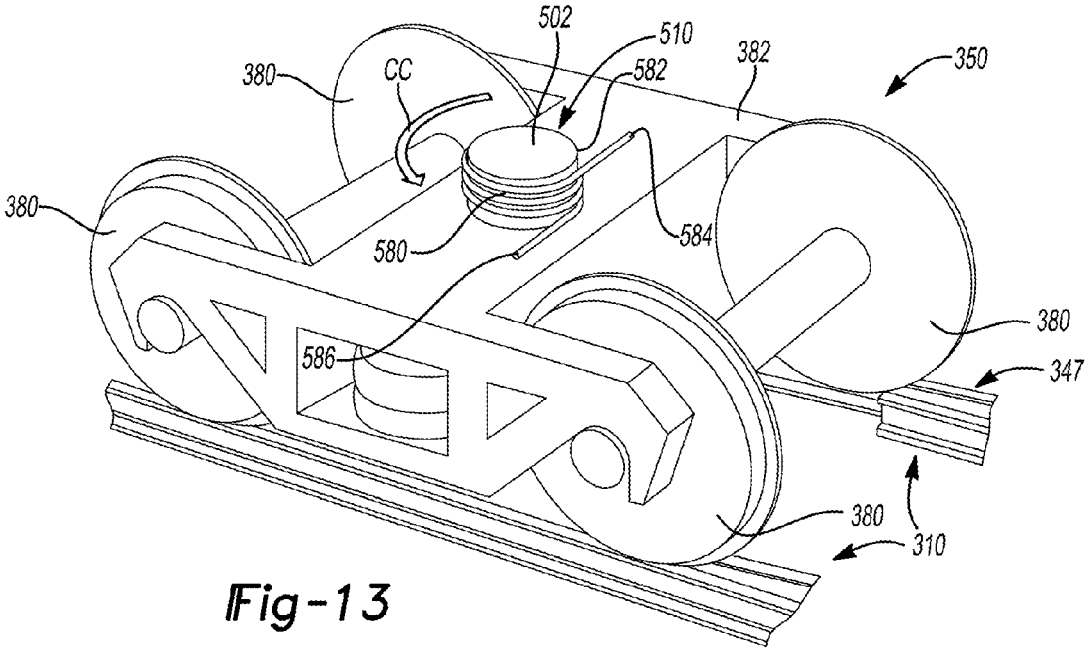
FIG. 13 is a perspective view of another embodiment of the preloading element shown in FIG. 10.
Figure 14:
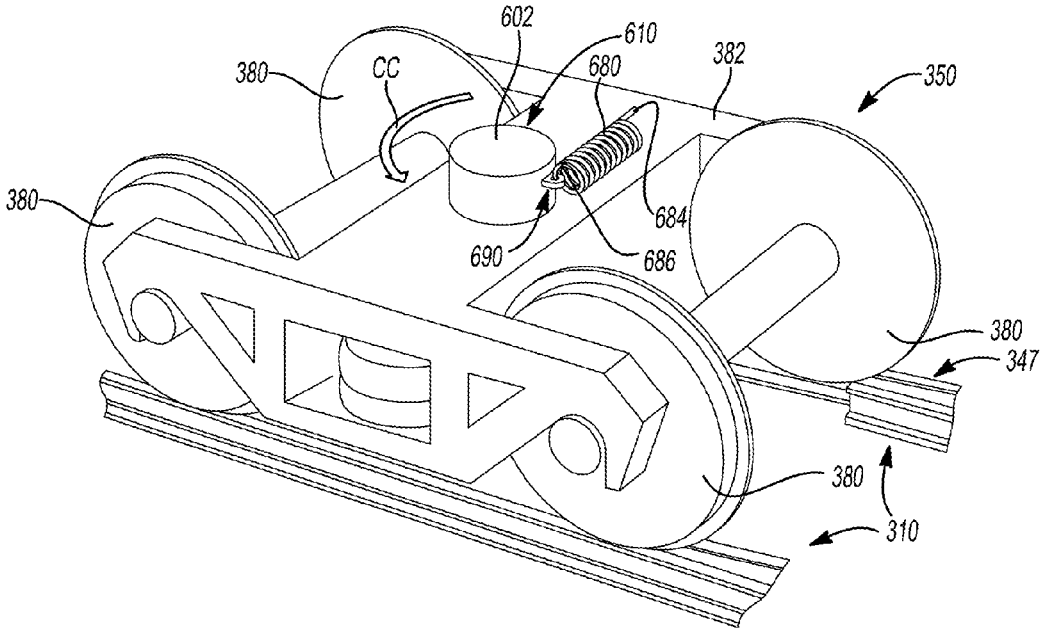
FIG. 14 perspective view of yet another embodiment of the preloading element shown in FIG. 10.

As explained in greater detail below, a railway car 350 (shown in FIG. 8) may include one or more preloading elements used to bias or direct one or more wheels 380 of the railway car 350 through the switch 347 (various embodiments of the preloading elements are illustrated in FIGS. 12-14 and are described in greater detail below). Those of ordinary skill in the art will readily appreciate that the railway car 350 may travel back and forth along the railway track 310, and within the switch 347. Referring to FIGS. 7-9, the railway car 350 may be guided from the main tracks 330, 340 and onto the diverging tracks 332, 342 as the railway car 350 travels in the facing direction D1 along the railway track 310. The railway car 350 may remain on the main tracks 330, 340 when the railway car 350 travels in the trailing direction D2 along the railway track 310. Furthermore, the railway car 350 may be guided from the diverging tracks 332, 342 and onto the main tracks 330, 340 as the railway car 350 is travelling in the trailing direction D2 along the railway track 310. As seen in FIG. 9, the switch 347 is positioned upstream of a turnout 348 of the railway track 310 when viewed along the facing direction D1.

Turning back to FIG. 7, similar to the embodiment as shown in FIG. 1, the first track section 320 and the second track section 322 each include respective flooded sections. Specifically, the first track section 320 includes a flooded section 360 and the second track section 322 includes a flooded section 370. The flooded section 360 of the first track section 320 may include a raised or elevated surface 362 disposed between the main track 330 and the guard rail 334. A portion of the flooded section 360 of the first track section 320 may also be located between the main track 330 and the diverging track 332. Similarly, the flooded section 370 of the second track section 322 may also include a raised or elevated surface 372 disposed between the main track 340 and the guard rail 344. A portion of the flooded section 370 may also be located between the main track 340 and the diverging track 342.

Referring to FIG. 8, the railway car 350 includes wheels 380, a bogie or truck portion 382, and a body portion 384. The truck portion 382 of the railway car 350 may be a chassis or framework for carrying the wheels 380. Specifically, referring to both FIGS. 8 and 10, the truck portion 382 may include two axles 388, however it is to be understood that this illustration is merely exemplary in nature. Those of ordinary skill in the art will readily appreciate that the truck portion 382 of the railway car 350 includes at least two axles. The truck portion 382 of the railway car 350 may also include a suspension 390 as well. For example, in the embodiment as shown, the suspension 390 may be a spring-based suspension. The body portion 384 of the railway car 350 may be used to contain or hold any type of goods therein.

Figure 10:
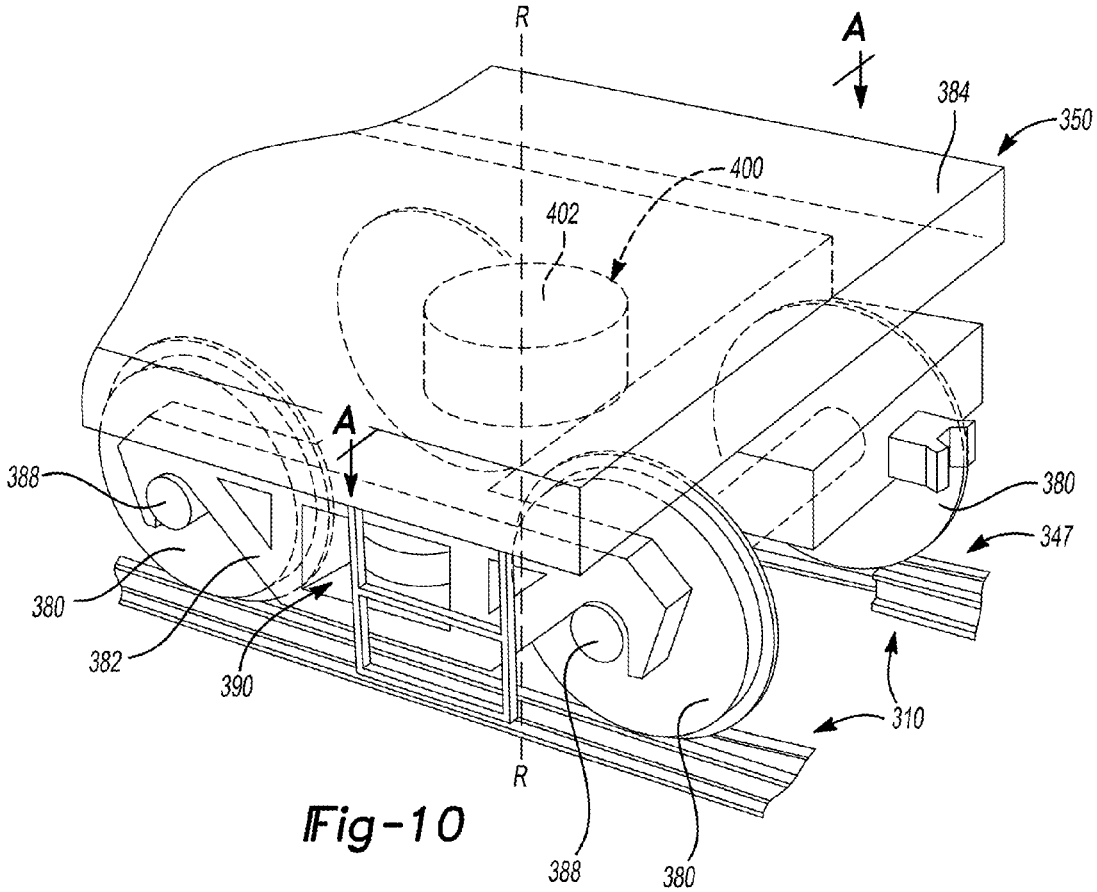
FIG. 10 is a perspective view of a rotational joint of the railway car.
Figure 11:
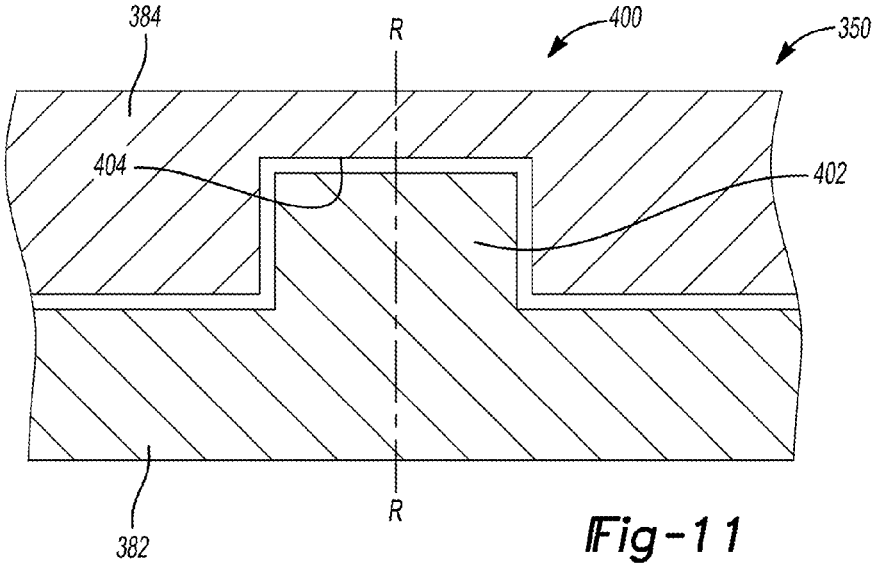
FIG. 11 is a cross-sectioned view of the rotational joint shown in FIG. 10, taken along section line A-A.

Referring to FIG. 10, the truck portion 382 of the railway car 350 may be connected to the body portion 384 by a rotational joint 400 (shown in phantom line). FIG. 11 is a cross-sectioned view of the rotational joint 400, taken along section line A-A. As seen in FIGS. 10 and 11, the rotational joint 400 includes a raised section 402, which is part of the truck portion 382 of the railway car 350. The rotational joint 400 also includes a receiving cavity 404 (seen in FIG. 11). The receiving cavity 404 is defined within the body portion 384 of the railway car 350. The raised section 402 is received within the receiving cavity 404 of the body portion 384. In the non-limiting embodiment as shown in FIGS. 10-11, the raised section 402 of the truck portion 382 is a generally cylindrical shaft and the receiving cavity 404 includes a shape that corresponds to the generally cylindrical shaft, however it is to be understood that the raised section 402 may include other profiles as well.

The truck portion 382 of the railway car 350 may be rotatable about an axis of rotation R-R of the rotational joint 400 relative to the body portion 384 of the railway car 350. In other words, the rotational joint 400 may define the axis of rotation R-R which the truck portion 382 may rotate about. The rotational joint 400 may be used to rotatably connect the truck portion 382 to the body portion 384 of the railway car 350. Specifically, the raised section 402 may pivot within the receiving cavity 404 of the body portion 384 in order to guide the railway car 350 along the railway track 310 as the railway car 350 travels in either the facing direction D1 or the trailing direction D2 (shown in FIG. 9). As explained below, the rotational joint 400 may include one or more preloading elements, such as the preloading element 410 illustrated in FIG. 12, which may be used to exert a biasing force that rotates the truck portion 382 about the axis of rotation R-R, thereby directing the wheels 380 of the railway car 350 through the switch 347 of the railway track 310 (FIG. 7).

As explained below, the truck portion 382 may pivot relative to the body portion 384 of the railway car 350 in order to switch from the main tracks 330, 340 and onto the diverging tracks 332, 342 (shown in FIGS. 7 and 9) as the railway car 350 travels within the switch 347 of the railway track 310 in the facing direction D1. Furthermore, the truck portion 382 may pivot relative to the body portion 384 in order to switch from the diverging tracks 332, 342 and onto the main tracks 330, 340 (shown in FIGS. 7 and 9) as the railway car 350 travels within the switch 347 of the railway track 310 in the trailing direction D2 along the railway track 310.

FIG. 12 is one embodiment of the preloading element 410 for directing the wheels 380 of the railway car 350 through the switch 347 of the railway track 310 (FIG. 7). The preloading element 410 may exert a torsional or biasing force in a counterclockwise direction CC in order to rotate the truck portion 382 relative to the body portion 384 of the railway car 350 (the body portion 384 is shown in FIG. 10). The biasing force may bias or direct the wheels 380 of the railway car 350 through the switch 347 (FIGS. 7 and 9) of the railway track 310.

In the exemplary embodiment as shown in FIG. 12, the preloading element 410 may include a cam-shaped shaft 412 that is an integral part of the raised section 402 of the truck portion 382 of the railway car 350. The cam-shaped shaft 412 may define a generally circular cross sectional area having a radius R as well as a lobed portion 418. The preloading element 410 may also include a follower 414 and a biasing element 416. The follower 414 includes a first end 420 and a second end 422. The first end 420 of the follower 414 is connected to the biasing element 416. The biasing element 416 may be any type of device for exerting a biasing force B against the first end 420 of the follower 414. For example, in the embodiment as shown in FIG. 12, the biasing element 416 is a compression spring. However, those of ordinary skill in the art will readily appreciate that other types of biasing elements may be used as well.

The second end 422 of the follower 414 may make contact with the cam-shaped shaft 412 of the truck portion 382 of the railway car 350. In particular, the second end 422 of the follower 414 makes contact with and exerts the biasing force B from the biasing element 416 against an outer surface 430 of the cam-shaped shaft 412, along a side surface 432 of the lobed portion 418. During operation of the railway car 350, the second end 422 of the follower 414 continuously exerts the biasing force B against the side surface 432 of the lobed portion 418 of the cam-shaped shaft 412.

Referring now to FIGS. 7-12, when the railway car 350 travels along the substantially straight main tracks 330, 340 the truck portion 382 and the body portion 384 of the railway car 350 are generally aligned with one another. In other words, the truck portion 382 of the railway car 350 is substantially unable to pivot or otherwise rotate about the axis of rotation R-R of the rotational joint 400 when the railway car 350 travels along the substantially straight main tracks 330, 340. Those of ordinary skill in the art will readily appreciate that the truck portion 382 of the railway car 350 is unable to rotate about the axis of rotation R-R of the rotational joint 400 of the railway car 350 because the main tracks 330, 340 of the railway track 310 are substantially straight. However, once the wheels 380 of the railway car 350 enter the switch 347 of the railway track 310, then the biasing force B exerted by the biasing element 416 urges the cam-shaped shaft 412 of the preloading element 410 to rotate in the counterclockwise direction CC about the axis of rotation R-R (seen in FIG. 12). Accordingly, the wheels 380 of the railway car 350 may also turn or twist in the counterclockwise direction CC as well.

Continuing to refer to FIGS. 7-12, the wheels 380 of the railway car 350 may turn in the counterclockwise direction CC, thereby guiding the railway car 350 from the main tracks 330, 340 and onto the diverging tracks 332, 342 as the railway car 350 travels in the facing direction D1 within the switch 347. However, the railway car 350 may remain on the main tracks 330, 340 when the railway car 350 travels in the trailing direction D2 within the switch 347 of the railway track 310. Furthermore, as the railway car 350 travels in the trailing direction D2 within the switch 347 of the railway track 310, the wheels 380 of the railway car 350 may turn in the counterclockwise direction CC, thereby guiding the wheels 380 of the railway car 350 from the diverging tracks 332, 342 and onto the main tracks 330, 340.

FIG. 13 is an illustration of an alternative embodiment of a preloading element 510 for directing the wheels 380 of the railway car 350 through the switch 347 of the railway track 310. Similar to the embodiment as shown in FIG. 12, the preloading element 510 may also exert a biasing force in the counterclockwise direction CC in order to rotate the truck portion 382. In the exemplary embodiment as shown in FIG. 13, the preloading element 510 may be a torsional spring 580. The torsional spring 580 may be wound around an outer surface 582 of a raised section 502 of the truck portion 382 of the railway car 350. The torsional spring 580 may include a first end 584 and a second end 586. The first end 584 of the torsional spring 580 may be fixedly attached to the truck portion 382 of the railway car 350 (the attachment is not illustrated in FIG. 13). Similarly, the second end 586 of the torsional spring 580 may also be fixedly attached to the truck portion 382 of the railway car 350 (the attachment is also not illustrated in FIG. 13).

FIG. 14 illustrates yet another embodiment of a preloading element 610 for directing the wheels 380 of the railway car 350 through the switch 347 of the railway track 310. Similar to the embodiment as shown in both FIGS. 12 and 13, the preloading element 610 may also exert a biasing force in the counterclockwise direction CC as well to rotate the truck portion 382 of the railway car 350. The preloading element 610 may be a torsional spring 680. The torsional spring 680 may include a first end 684 and a second end 686. The first end 684 of the torsional spring 680 may be fixedly attached to the truck portion 382 of the railway car 350 (the attachment is not illustrated in FIG. 14). The second end 686 of the torsional spring 680 may also be fixedly attached to a raised section 602 of the truck portion 382 of the railway car 350. Specifically, the raised section 602 of the truck portion 382 of the railway car 350 may include an eyelet 690 for receiving and securing the second end 686 of the torsional spring 680.

It is to be understood that FIGS. 12-14 merely illustrate a few examples of the disclosed preloading element, and that the preloading element may be any type of device that directs the wheels 380 of the railway car 350 through the switch 347 (FIG. 9) of the railway track 310. In particular, the disclosed preloading element may include hydraulic, pneumatic, or magnetic elements that rotate the truck portion 382 of the railway car 350 about the axis of rotation R-R of the rotational joint 400 (seen in FIG. 10).

Referring generally to FIGS. 7-14, the disclosed railway car 350 includes a preloading element that biases the wheels 380 of the railway car 350 in a counterclockwise direction. Accordingly, the preloading element may provide an alternative approach for directing the wheels 380 of the railway car 350 through the switch 347. The disclosed passive switch does not generally require periodic replacement and maintainance like most railway switches that are currently available for guiding a railway car through a switch.

While the forms of apparatus and methods herein described constitute preferred aspects of this disclosure, it is to be understood that the disclosure is not limited to these precise forms of apparatus and methods, and the changes may be made therein without departing from the scope of the disclosure.

What is claimed is:

1. A railway car for traveling within a switch of a railway track, comprising:

a body for containing goods, wherein the body defines a receiving cavity disposed along a first surface of the body;

a truck that is a framework for carrying a plurality of wheels of the railway car, the truck defining a raised section disposed along a second surface of the truck, wherein the raised section is shaped to be received within the receiving cavity of the body when the first surface of the body and the second surface of the truck are positioned opposite one another, and wherein the truck is rotatably connected to the body and is rotatable about an axis of rotation relative to the body; and a rotational joint defining the axis of rotation which the truck is rotatable about, the rotational joint defined by the receiving cavity of the body and the raised portion of the truck, and wherein the rotational joint rotatably connects the truck to the body of the railway car.

2. The railway car of claim 1, wherein the rotational joint includes at least one preloading element that exerts a biasing force for directing the plurality of wheels of the railway car through the switch of the railway track.

3. The railway car of claim 2, wherein the biasing force is directed in a counterclockwise direction.

4. The railway car of claim 2, wherein the preloading element includes a cam-shaped shaft that is an integral part of the truck of the railway car.

5. The railway car of claim 4, wherein the preloading element includes a follower and a biasing element, and wherein the follower includes a first end and a second end.

6. The railway car of claim 5, wherein the first end of the follower is connected to the biasing element and the second end of the follower contacts the cam-shaped shaft.

7. The railway car of claim 2, wherein the preloading element includes a torsion spring that is wound around an outer surface of a raised section of the truck of the railway car.

8. The railway car of claim 7, wherein torsional spring includes a first end and a second end, and wherein both the first end and the second end of the torsional spring are fixedly attached to the truck of the railway car.

9. The railway car of claim 2, wherein the preloading element includes a torsion spring that includes a first and a second end, wherein the first end of the torsional spring is fixedly attached to the truck of the railway car.

10. The railway car of claim 9, wherein the second end of the torsional spring is fixedly attached to a raised section of the truck of the railway car.

11. The railway car of claim 10, wherein the raised section of the truck includes an eyelet for receiving and securing the second end of the torsional spring.

12. The railway car of claim 1, wherein the truck of the railway car includes a spring-based suspension.

13. The railway car of claim 1, wherein the truck of the railway car includes at least two axles.

14. A method of switching a railway car from main tracks to diverging tracks of a railway track when the railway car is traveling in a facing direction, the method comprising:

guiding a plurality of wheels of the railway car along the main tracks, wherein the railway car includes a body and a truck that is rotatable about an axis of rotation relative to the body, the body defining a receiving cavity disposed along a first surface of the body and the truck defining a raised section disposed along a second surface of the truck, wherein the raised section is shaped to be received within the receiving cavity of the body when the first surface of the body and the second surface of the truck are positioned opposite one another;

exerting a biasing force by a preloading element that rotates the truck about the axis of rotation, wherein the preloading element is part of a rotational joint that defines the axis of rotation which the truck is rotatable about, the rotational joint defined by the receiving cavity of the body and the raised portion of the truck; and guiding the plurality of wheels of the railway car through a switch of the railway track and onto the diverging tracks as the plurality of wheels travel in the facing direction.

15. The method of claim 14, comprising exerting the biasing force by the preloading element to guide the plurality of wheels of the railway car from the diverging tracks and onto the main tracks as the plurality of wheels travel in a trailing direction.

16. The method of claim 14, wherein the preloading element includes a cam-shaped shaft that is an integral part of the truck of the railway car.

17. The method of claim 16, wherein the preloading element includes a follower and a biasing element, and wherein the follower includes a first end and a second end.

18. The method of claim 17, wherein the first end of the follower is connected to the biasing element and the second end of the follower contacts the cam-shaped shaft.

19. The method of claim 14, wherein the preloading element includes a torsion spring that is wound around an outer surface of a raised section of the truck of the railway car.

20. The method of claim 14, wherein the preloading element includes a torsion spring that includes a first and a second end, wherein the first end of the torsional spring is fixedly attached to the truck of the railway car and the second end of the torsional spring is fixedly attached to a raised section of the truck of the railway car.

* * * * *